United States Patent [19]

Hyun

[11] Patent Number: 4,482,088

[45] Date of Patent: Nov. 13, 1984

[54] MEANS FOR SUPPLYING FASTENERS IN A TAG ATTACHING APPARATUS

[76] Inventor: Kyu H. Hyun, Minyong Apt., Block "Q", Room No. 606, 301-112, Ichon-dong, Yongsan-ku, Seoul, Rep. of Korea

[21] Appl. No.: 375,185

[22] Filed: May 5, 1982

[30] Foreign Application Priority Data

Jun. 21, 1981 [KR] Rep. of Korea ..... 4601

[51] Int. Cl.[3] ..... A43D 69/00

[52] U.S. Cl. ..... 227/67; 227/68

[58] Field of Search ..... 277/67, 68, 156, 64, 277/27; 112/225, 226

[56] References Cited

U.S. PATENT DOCUMENTS

| | | | |
|---|---|---|---|
| 3,895,753 | 7/1975 | Bone | 227/67 X |
| 4,040,555 | 8/1977 | Jenkins | 227/67 |
| 4,049,177 | 9/1977 | Bussard | 227/67 |
| 4,049,179 | 9/1977 | Jenkins | 227/67 |

*Primary Examiner*—E. R. Kazenske
*Assistant Examiner*—Willmon Fridie, Jr.
*Attorney, Agent, or Firm*—Oblon, Fisher, Spivak, McClelland & Maier

[57] ABSTRACT

A tag attaching apparatus including a frame (1), a hollow needle (2) for attaching fasteners (5), a fastener supply gear wheel (3), a plunger (8) the sliding motion of which actuates a bell crank mechanism for incrementing the fastener supply gear wheel (3), and a pawl (12) which prevents reverse motion of the fastener supply gear wheel (3).

1 Claim, 2 Drawing Figures

MEANS FOR SUPPLYING FASTENERS IN A TAG ATTACHING APPARATUS

DETAILED DESCRIPTION OF INVENTION

Figure 1:
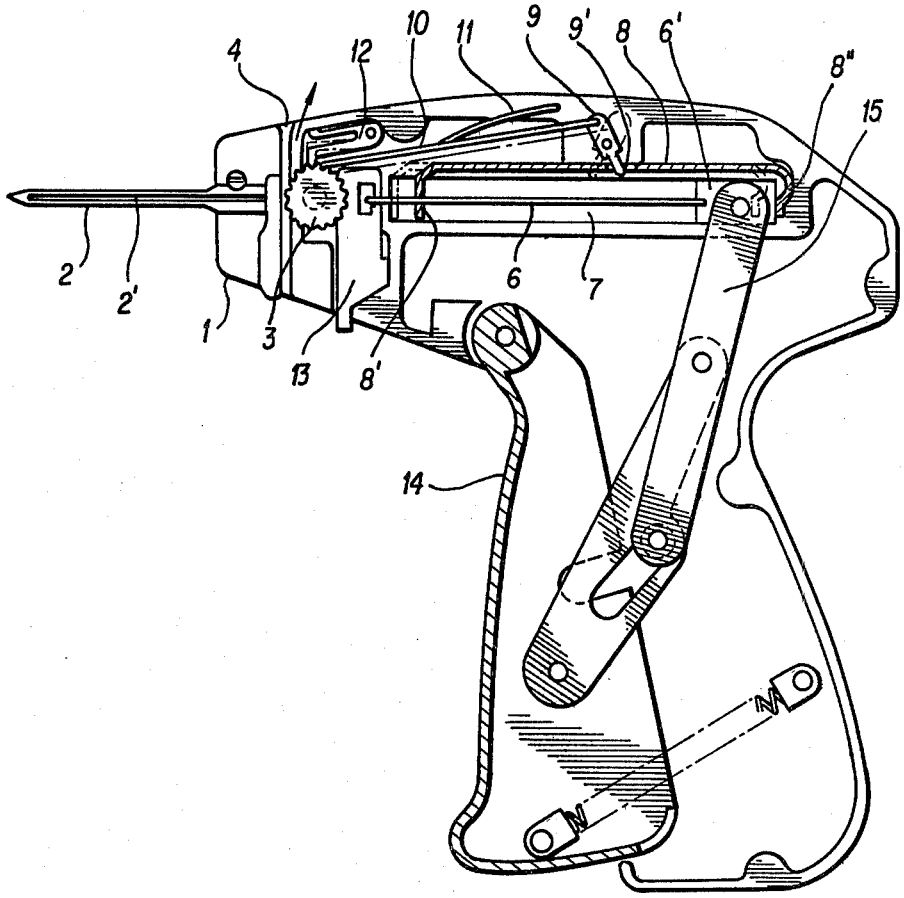
FIG. 1 is the side view of the tag attaching apparatus in the present invention.
Figure 2:
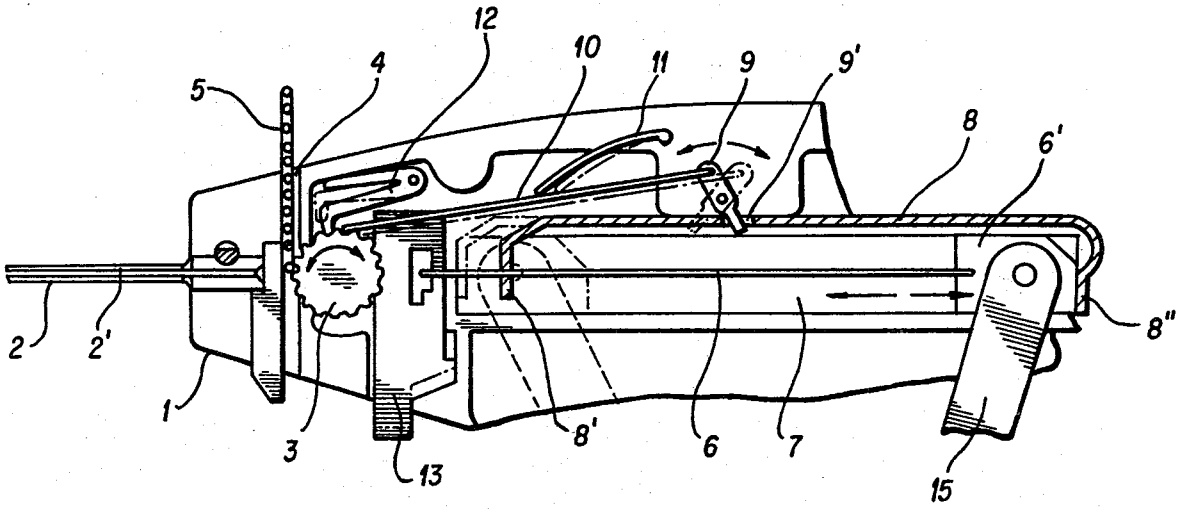
FIG. 2 is the side view of the tag attaching apparatus in the present invention, illustrating in detail the operating state of the subject matters characterized by the present invention.

This invention relates to the means for supplying the fasteners in a tag attaching apparatus. In a tag attaching apparatus, the present invention contains characteristically the -type plunger as well as the pushing member and the pushing bar so that, every time when the lever is pushed and released, since the pushing bar induces one step of the rotation of the gear wheel, it is possible to supply regularly the fasteners one by one.

According to the prior arts, since the tag attaching apparatus contains the fasteners supplying means consisting of a complicated constructions, it has the defects that the cost to produce the apparatus is expensive and the apparatus has been broken down frequently.

According to the present invention, in a common tag attaching apparatus, in order to reform the operating system of the fastener supplying means to a simple one, the invention contains characteristically that, by connecting to the fastener supplying gear wheel the -type plunger located on the upper part of the hinge portion driving in the driving home and having the pressing pole pressing the fastener into the concave home of the needle, the pushing member locates on the central part of the plunger and the pushing bar connected to the pushing member. And, when the lever is pushed, by the forward driving of the plunger, the pressing bar pushes the fastener into the concave home of the needle and the tag is attached to the goods. Since the gear wheel is turned by each step caused by the mutual combination between the plunger, the pushing member and the pushing bar, it is possible to supply the fasteners one by one to the needle. And, the construction is very simple and the manufacture is easy so that the present invention is used conveniently and for a long time without causing any obstacle during the use.

The present invention is described in detail, according to the accompanying drawings, as follows:

In a common tag attaching apparatus having that the needle (2) excavated the concave home (2') is installed on the edge of the frame (1), the fastener supply gear wheel (3) is installed on the one side of the needle (2) and the fastener (5) is supplied in a line into the guiding aperture (4) located on between the gear wheel (3) and the needle (2), the present invention contains characteristically that the plunger (8) having the edge portions (8') and (8'') which drives to the forward direction and to the backward direction in the driving home (7) by the hinge portion (6') is located on the upper part of the driving home (7) of the hinge portion (6') having the pressing pole (6); the bottom of the pushing member (9) is hinged on the base (9') located on the upper part of the central part of the plunger (8); the pushing bar (10) connected to the upper part of the pushing member (9) is pressed to touch with the gear wheel (3) by the spring (11); and, since the unloosing member (13) is located on the front edge of the frame (1) and, when the unloosing member (13) is pushed upwardly, the locking member (12) is separated from the gear wheel (3).

According to the present invention, the tag is attached to the goods by a common way and, however, when the lever (14) is pushed, the hinge portion (6') moves forwardly by the hinge support (15) so that the pressing pole (6) pushes one of the fasteners (5) into the concave home (2') of the needle (2) and, when the tag is attached to the goods, the edge portion (8') of the plunger (8) drives a little by the hinge portion (6') during the driving of the hinge portion (6') and the upper part of the pushing member (9) moves on the opposite direction. After the tag is attached, when the lever (14) is released, the hinge portion (6') returns to the original state and the edge portion (8'') of the plunger (8) is driven to the opposite direction by the hinge portion (6'). Then, the upper part of the pushing member (9) causes to return to the opposite direction and, since the pushing member (9) causes the movement of the pushing bar (10) and the gear wheel (3) is turned, one of the fasteners (5) is supplied to the needle.

As explained above, it is notable that the present invention contains characteristically the pushing bar (10), the pushing member (9) and the -type plunger (8) consisting of the edge portions (8'') and (8') having the pressing pole (6) and locating on the upper part of the hinge portion (6') moving in the space of the driving home (7) and, by the mutually connected operation of the plunger (8), the pushing member (9) and the pushing bar (10) caused by the movement of the hinge portion (6'), the gear wheel (3) supplying the fasteners (5) is driven.

There is the effect that the construction is so simple that the manufacture is very easy and the operation is exact and the present invention can be used conveniently for a long time without any obstacle.

I claim:

1. A tag attaching apparatus comprising:

(a) a frame (1);

(b) a hollow needle (2) for attaching fasteners (5), said hollow needle (2) being mounted on the front of said frame (1);

(c) a fastener supply gear wheel (3) mounted on said frame (1) in position to supply fasteners (5) to said hollow needle (2), said fasteners (5) being supplied to said fastener supply gear wheel (3) through an aperture (4) in said frame (1) located between said fastener supply gear wheel (3) and the rear end of said hollow needle (2);

(d) a plunger (8) mounted in a driving home (7) in said frame (1) behind said fastener supply gear wheel (3), said plunger (8) having a base which is disposed parallel to said hollow needle (2), a front edge portion (8') which projects from said base perpendicularly to said hollow needle (2), and a rear edge portion (8'') which projects from said base perpendicularly to said hollow needle on the same side of said base as said front edge portion (8'), said plunger (8) being slidably movable in said driving home (7) in the direction parallel to said hollow needle (2);

(e) a hinge portion (6') mounted in said plunger (8) in engagement with said rear edge portion (8'');

(f) a pressing pole (6) which projects forwardly from said hinge portion (6') in the direction parallel to said hollow needle (2), said pressing pole (6) projecting through said front edge portion (8');

(g) a pushing member (9) pivotably mounted on a pin which is in turn is mounted in said frame (1), said pin being perpendicular to said hollow needle (2), said pushing member having a front end which is engaged in a slot (9') in said base such that motion of said plunger (8) in the forward and rearward directions causes said pushing member (9) to pivot about said pin, said pushing member (9) having a second end which extends on the opposite side of said pin from said first end;

(h) a pushing bar (10) the rearward end of which is pivotably connected to said second end of said pushing member (9) and the forward end of which drivingly engages said fastener supply gear wheel (3);

(i) a spring (11) which is mounted on said frame (1) and which biases said pushing bar (10) into engagement with said fastener supply gear wheel (3);

(j) a locking member (12) in the form of a pawl which prevents reverse motion of said fastener supply gear wheel (3), said locking member (12) being pivotably mounted on said frame (1) and having a spring leg which resiliently biases said locking member into engagement with said fastener supply gear wheel (3);

(k) an unloosing member (13) mounted in said frame (1) between said fastener supply gear wheel (3) and the forward end of said pressing pole (6), said unloosing member (13) being slidably movable in said frame (1) in the direction perpendicular to said hollow needle (2), said unloosing member (13) being positioned such that, when it is pushed upwardly, it engages said locking member (12) and separates it from said fastener supply gear wheel (3);

(l) manually manipulatable lever means (14, 15) mounted on said frame (1) for forcing said hinge portion (6') forwardly so that said pressing pole (6) pushes one of the fasteners (5) into said hollow needle (2) and said pushing member (9) and said pushing bar (10) cause said fastener supply gear wheel (3) to rotate by one increment; and (m) spring means for returning said manually manipulatable lever means (14, 15), said hinge portion (6'), said pushing member (9), and said pushing bar (10) to their original positions upon release of said manually manipulatable lever means (14, 15).

* * * * *